United States Patent [19]

Stewart et al.

[11] 4,439,406

[45] Mar. 27, 1984

[54] METHOD OF CAPTURING SULFUR

[75] Inventors: Robert D. Stewart, Verona; Robert L. Gamble, Wayne, both of N.J.

[73] Assignee: Foster Wheeler Energy Corporation, Livingston, N.J.

[21] Appl. No.: 364,918

[22] Filed: Apr. 2, 1982

Related U.S. Application Data

[62] Division of Ser. No. 148,339, May 9, 1980, Pat. No. 4,333,909.

[51] Int. Cl.[3] ..... B01J 8/00; C01B 17/00

[52] U.S. Cl. ..... 423/244; 110/345

[58] Field of Search ..... 423/242 A, 242 R, 244 A, 423/244 R; 110/343, 345

[56] References Cited

U.S. PATENT DOCUMENTS

| | | | |
|---|---|---|---|
| 2,584,312 | 2/1952 | White | 263/21 |
| 2,586,018 | 2/1952 | Hams | 422/145 |
| 2,673,081 | 3/1954 | Fay et al. | 263/21 |
| 3,236,607 | 2/1966 | Porter et al. | 422/141 |
| 3,995,987 | 12/1976 | MacAskill | 432/15 |
| 3,998,929 | 12/1976 | Leyshon | 422/143 |
| 4,059,393 | 11/1977 | Kobayashi | 432/58 |
| 4,096,642 | 6/1978 | Triebel | 34/57 R |
| 4,135,885 | 12/1981 | Warmser | 422/142 |
| 4,279,207 | 7/1981 | Wormser | 110/345 |
| 4,303,023 | 12/1981 | Perkins et al. | 110/345 |

*Primary Examiner*—Gregory A. Heller

*Attorney, Agent, or Firm*—Marvin A. Naigur; John E. Wilson; Warren B. Kice

[57] ABSTRACT

A fluidized bed boiler, and a method of operating same in which air is passed through a grate to fluidize a bed of particulate material containing fossil fuel disposed on the grate. A raw acceptor for the sulfur produced as a result of the combustion of the fuel is introduced into the housing and confined within an area of the housing isolated from the bed of particulate material. The area containing the acceptor is maintained at conditions optimal for calcining the acceptor, after which the latter is introduced into the fluidized bed.

19 Claims, 3 Drawing Figures

METHOD OF CAPTURING SULFUR

This application is a divisional of application Ser. No. 148,339, filed May 9, 1980, now U.S. Pat. No. 4,333,909.

BACKGROUND OF THE INVENTION

The present invention relates to a fluidized bed boiler and a method of operating same, and more particularly to such a boiler and method in which an acceptor is introduced into the fluidized bed for capturing the sulfur generated during the combustion process.

Fluidized bed reactors or boilers have long been recognized as an attractive and effective means of generating heat when used as a gasifier, combustor, or the like. In these arrangements air is passed through a bed of particulate material which normally consists of a mixture of inert material, a particulate fossil fuel, such as bituminous coal, and an acceptor, such as limestone, used for the capture of sulfur generated during the gasification or combustion of the fossil fuel. The air fluidizes the bed and promotes the combustion of the fuel resulting in a combination of high heat release, improved heat transfer to surfaces within the bed and compact reactor or combustor size.

In these types of arrangements, it is hightly advantageous to use a calcined limestone, normally referred to as "lime", since, if calcined, the lime is 30% to 50% more effective in capturing the sulfur from the combusted fossil fuel when compared to raw limestone that has not been calcined.

Although it is possible to calcine the limestone directly within the fluidized bed, the reaction is usually completed less efficiently due to the temperatures and conditions that must be maintained within the bed which results in reduced reactivity for most limestone acceptors. In addition, breaking up of the limestone particles into very fine particles occurs on shock heating, with these fine particles being carried away from the bed with the mixture of air and gaseous products of combustion. These effects, of course, also reduce the effectiveness of the acceptors.

According to some prior art techniques, the raw limestone can be calcined externally of the fluidized bed, or purchased in a calcined form, before it is introduced into the bed. However, since calcined limestone costs approximately eight to ten times more than raw uncalcined limestone, it can be appreciated that this can considerably add to the cost of the process.

SUMMARY OF THE INVENTION

It is therefore an object of the present invention to provide a fluidized bed boiler and a method of operating same in which the additional cost of precalcined limestone is avoided.

It is a further object of the present invention to provide a fluidized bed boiler and method of the above type in which raw limestone is calcined utilizing the heat of the fluidized bed boiler yet is broken up into fine particles by rapid thermal shock.

It is still a further object of the present invention to provide a fluidized bed boiler and method of the above type in which raw limestone is introduced into the boiler and is calcined in an area isolated from the bed before being introduced into the bed in a calcined form.

Toward the fulfillment of these and other objects, a grate is supported in a housing and is adapted to receive a bed of particulate material at least a portion of which is fossil fuel. Air is passed through the grate and the particulate material to fluidize the particulate material. An acceptor for the sulfur produced as a result of the combustion of the fuel is introduced into the housing and maintained in a confined area of the housing that is isolated from the bed of particulate material. This confined area is maintained at calcining conditions to calcine the acceptor after which it is introduced into the bed for accepting the sulfur generated by the fossil fuel in the combustion process.

DESCRIPTION OF THE PREFERRED EMBODIMENT

Figure 1:
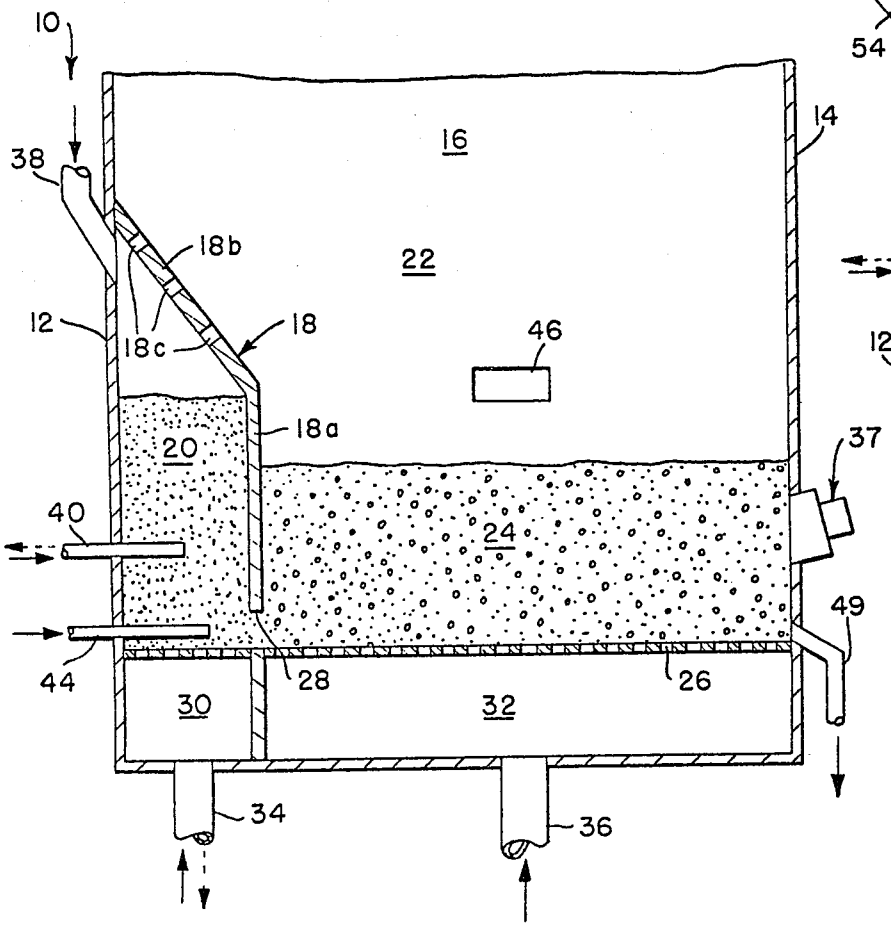

Referring specifically to FIG. 1 of the drawings, the reference number 10 refers in general to a portion of a fluidized bed boiler of the present invention which comprises a front wall 12, a rear wall 14 and two side walls, one of whch is shown by the reference numeral 16. The upper portion of the boiler is not shown for the convenience of presentation, it being understood that it consists of a convection section, a roof and an outlet for allowing the combustion gases to discharge from the boiler, in a conventional manner.

A partition 18 is disposed within the boiler and has a vertical portion 18*a* which extends in a parallel relation to the front wall 12 and the rear wall 14, and a slanted portion 18*b* which extends from the upper extremity of the vertical portion 18*a* to the front wall 12 and which has a plurality of openings 18*c*, for reasons to be described later. The partition 18 defines a first chamber 20 extending between the front wall 12 and the partition 18, and a second chamber 22 extending between the partition and the rear wall 14.

A bed of particulate material, shown in general by the reference numeral 24, is disposed within the chamber 22 and rests on a perforated grate 26 extending horizontally in the lower portion of the boiler and defining the lower extremities of both chambers 20 and 22. The bed of particulate material 24 can consist of a mixture of discrete particles of inert material, and a fossil fuel material such as bituminous coal. The lower extremity of the vertical portion 18*a* of the partition 18 can terminate slightly above the grate 26 to form a through passage 28 that permits transfer of material from the chamber 20 to the chamber 22, as will be described in detail later. Alternatively, holes can be provided in the lower portion of partition 18 for the same effect.

Two air plenum chambers 30 and 32 are disposed immediately underneath the chambers 20 and 22 respectively and are provided with air inlets 34 and 36, respectively, for distributing air from an external source to the chambers. It is understood that air dampers or the like (not shown) may be provided in association with the inlets 34 and 36 or the chambers 30 and 32 for controlling the flow of air into and through the latter chambers.

A bed light-off burner 37 or the like could be mounted through the rear wall 14 or the front wall 12 immediately above the grate for initially lighting off the bed 20 or bed 24 during start up.

An inlet pipe 38 is provided through the front wall 12 in communication with the chamber 20 for introducing into the chamber an acceptor, such as raw limestone, for the sulfur produced by the fossil fuel during the combustion process. This acceptor would be in the form of a particulate material which falls into the chamber 20 and accumulates to a pre-selected height, such as the one shown in FIG. 1, in the chamber 20.

A gas inlet pipe 40 extends through the wall 12 into the chamber 20 for passing a high temperature gas, a combustible gas, or carbon dioxide rich flue gas into the chamber 20. The pipe 40 can also be connected to an exhaust fan or the like for removing gases from the chambers 20 and 22 as will be described in detail later. An air inlet pipe 44 also extends through the front wall 12 in communication with the lower portion of the chamber 20 and is adapted to receive pressurized air from an external source (not shown) and discharge same toward the passage 28 to assist the movement of the acceptor from the chamber 20 to the chamber 22.

An inlet 46 is provided through the side wall 16 (and the other side wall, as necessary) for introducing the particulate fuel material into the chamber 22 where it falls upon the upper surface of the bed 24 to replace the fuel material consumed during the combustion process. A drain pipe 49 extends through the rear wall 14 in communication with the lower portion of the bed 24 for expelling spent fuel material from the bed.

In operation, air is introduced into the chamber 32 via the air inlet 36 whereby it passes upwardly through the grate 26 and the bed 24 of fluidized material in the chamber 22 before it exits through a suitable outlet provided in the top of the boiler. This loosens the particulate material in the bed 24 and fluidizes it. The light-off burner 37 is then fired to heat the material in the bed 24 until the bed reaches a predetermined elevated temperature after which particulate fuel material is introduced into the chamber 22 and the bed 24 via the inlet 46. Upon establishing good combustion the burner 37 can be turned off.

As soon as the bed reaches its normal operational temperature, such as approximately 1550° F., the raw limestone is introduced into the chamber 20 via the inlet 38 where it accumulates in the latter chamber. The elevated temperature in the chamber 22 also raises the temperature of the limestone in the chamber 20. A gas, which could be a high temperature gas, a combustible gas, or carbon dioxide-rich flue gas, or the like, is introduced into the chamber 20 as needed via the inlet pipe 40. As a result, a partial pressure of carbon dioxide is maintained in the chamber 20 that is optimum for the calcining operation, and any excess gas, including carbon dioxide, discharges through the openings **18*c* formed in the partition 18. The air assist pipe 44 is activated to distribute the calcined limestone through the passage 28 into the lower portion of the chamber 22, it being understood that air can be introduced into the chamber 20 via the inlet 34 as needed to fluidize the limestone in the latter chamber and thus assist the movement of the limestone into the chamber 22. The limestone from the chamber 20 integrates with the bed material in the chamber 22 and accepts the sulfur produced as a result of the combustion of the fossil fuel. Alternatively, the pipes 40 or 34 could be connected to an exhaust fan and high temperature flue gases of increased carbon dioxide content can be gradually drawn from the chamber 22 through the openings 18*c* in the partition 18 and evacuated through the pipe 40, or through the grid 30 and pipe 34**.

In the event that the heat from the fluidized bed 24 is not sufficient to calcine the limestone in the chamber 20, particles of fuel, such as bituminous coal, can be introduced into the chamber with the limestone through the inlet 40. This fuel would be ignited in the manner described above and air would be introduced, via the inlet 34, into the air plenum chamber 30 where it passes upwardly through the chamber 20 to fluidized the bed, promote combustion of the fuel and thus raise the temperature in the chamber 20 sufficiently to calcine the limestone.

It is thus seen that the embodiment of FIG. 1 provides a highly efficient calcination of the raw limestone in an area separate from the fluidized bed followed by an integration of the calcined lime into the bed. Alternatively this calcining bed can be located external and adjacent to the main bed housing 14.

Figure 2:
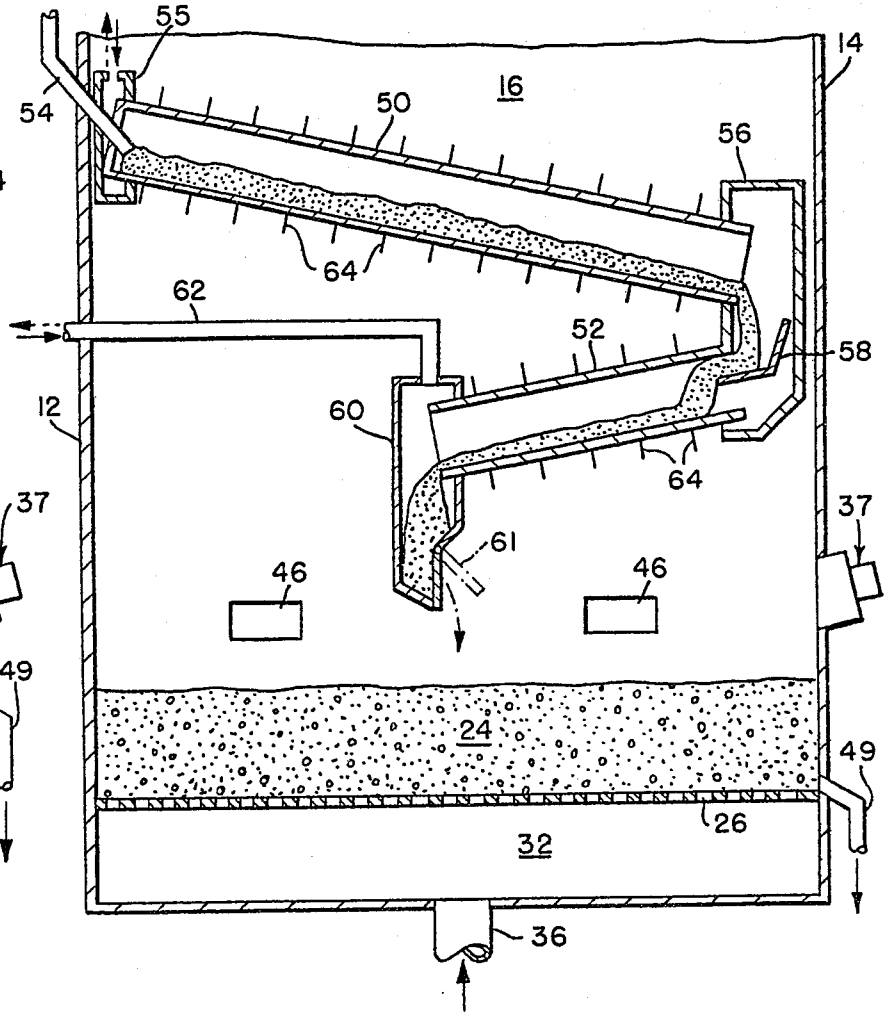
Figure 3:
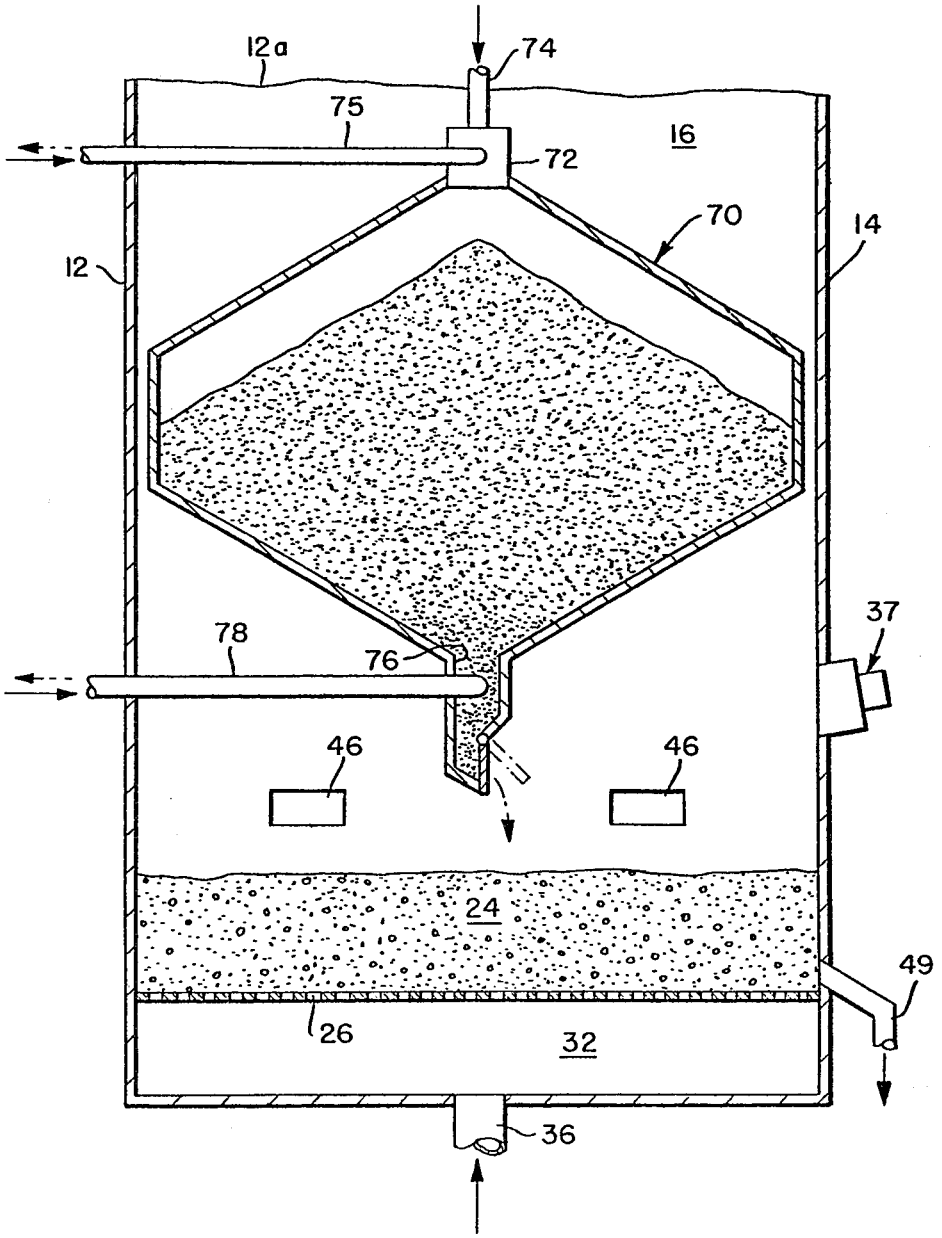

The embodiments of FIGS. 2 and 3 involve different techniques of calcination of the limestone and, to the extent that they involve identical structure as the embodiment of FIG. 1, the same reference numerals are used.

Referring specifically to FIG. 2, a single fluidized bed 24 of particulate inert material and fossil fuel material is disposed over a grate 26 which is disposed immediately above a single air plenum chamber 32 receiving air from an inlet 36. A pair of inlets 46 for particulate fuel material are provided in the side wall 16, it being understood that other inlets can be provided on the other side wall as needed.

According to this embodiment, a feeding system for the raw limestone to be calcined is provided in the freeboard space above the bed 24 and includes a pair of conveying and heating units 50 and 52 in the form of conduits. The unit 50 extends angularly downwardly from the front wall 12 to the rear wall 14 and the unit 52 is located below the unit 50, is slanted downwardly from the rear wall to the front wall and terminates in an area approximately midway between the latter walls. An inlet pipe 54 extends from an external source (not shown) of limestone, through the wall 12 and registers with the unit 50 to introduce the limestone into the latter unit. A distributor box 55 extends over the end of the unit 50 to provide for the passage of carbon dioxide-rich gases to or from the unit.

Due to the slanted arrangement of the unit 50, the limestone could flow from its upper end to its lower end by gravity or, alternatively, the units could be in the form of pipes or trays which could be rotated or vibrated, respectively, by external drives (not shown) to promote flow. In all cases heat is transferred from gas space 20 to the units 50 and 52 to support the endothermic calcining reaction taking place.

A support box 56 receives the lower end of the unit 50 as well as the upper end of the unit 52 and includes a baffle 58 which directs the limestone discharging from the unit 50 to the unit 52. The limestone thus flows down the unit 52 before discharging into an outlet box 60 which communicates with the discharge end of the unit 52. The outlet box 60 receives the calcined limestone from the unit 52 and has an isolated lower end including a pivoted plate 61 that permits the limestone to discharge onto the upper surface of the fluidized bed 24. A pipe 62 is provided in communication with the outlet box 60 and functions in the same manner as the pipe 40 of the previous embodiment, it being understood that a pipe could be associated with the distributor box 55 and perform the same function.

A plurality of heat transfer fins 64 are provided on the external surfaces of the units 50 and 52 to aid in the transfer of the heat from the fluidized bed 24 to the limestone in the units.

According to the operation of the embodiment of FIG. 2, raw limestone is introduced into the unit 50 via the inlet pipe 54 where it cascades downwardly through the units 50 and 52 before discharging from the distributor box 60. The size of the units 50 and 52 are selected and the flow rate of limestone flow through the units is regulated, so that an adequate residence time of the limestone in the units is established to pick up sufficient heat from the fluidized bed 24. This, plus the passage of gas into or from the distributor box 55 and the outlet box 60 ensures optimum calcination of the limestone by the time it discharges from the distributor.

According to the embodiment of FIG. 3, a subenclosure, or chest, 70 is provided in the freeboard space above the fluidized bed 24. The chest 70 includes a distributor box 72 which receives raw limestone from an inlet pipe 74 extending through the top (not shown) of the chest and connected to an external source (not shown) of limestone. A pipe 75 extends through the front wall 12 and communicates with the distributor box 72 for the passage of gases to and from the box as discussed in the previous embodiments. The lower portion of the chest 70 is funnel-shaped and has an outlet box 76 for discharging the limestone into the upper surface of the fluidized bed 24. A pipe 78 extends in communication with the outlet box 76 for passing gases into and from the outlet in the same manner as the pipe 40 of the first embodiment.

The chest 70 occupies a substantial area in the freeboard space above the fluidized bed, it being understood that the depth of the chest 70 in the plane of the drawing is less than the corresponding distance between the sidewalls 16. The flow rate of raw limestone through the chest 70 is regulated so that the limestone will accumulate in the chest as shown before discharging from the outlet 76 to ensure an adequate residence time of the limestone in a heat exchange relation with the heat from the fluidized bed 24. This plus the regulation of the gases passing into and from the distributor box 72 and the outlet box 76 enables optimum calcining conditions to be maintained. As a result, the limestone discharged from the outlet box 76 is calcinated in order to achieve a maximum acceptance of the sulfur formed during the combustion of the fossil fuel particles in the fluidized bed.

Therefore, it is apparent that the embodiments of FIGS. 2 and 3 enjoy the efficiency discussed above in connection with FIG. 1 while also enabling the calcination steps to be achieved at a relatively low cost.

It is understood that variations may be made in the foregoing without departing from the scope of the invention. For example, in the embodiment of FIG. 1, the chamber 20 can be located externally of the housing yet adjacent to the chamber 20. Also, heat exchange tubes can be provided in the boiler of the present invention for the purpose of passing water in a heat exchange relationship with the fluidized bed to add heat to the water. Further, although raw limestone has been mentioned throughout the specification as the preferred form of acceptor, it is understood that other materials, such as dolomite, or the like, that contain limestone can be utilized as the acceptor without departing from the scope of the invention. Also, caralysts, such as surface salts or the like, can be added to the acceptor to promote the sulfur captured by the acceptor.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A method of capturing sulfur in a fluidized bed boiler comprising the steps of passing air through a bed of particulate material containing fuel and supported in a housing to fluidize said particulate material, establishing an area to one side of said fluidized bed and isolated from said fluidized bed, introducing into said area a raw acceptor for the sulfur produced as a result of combustion of said fuel, said area being in a heat transfer relation to the heat generated by said fluidized bed to calcine said acceptor, then introducing said calcined acceptor from said area into said bed where it reacts with said sulfur and discharging the sulfated acceptor from said housing.

2. The method of claim 1 comprising the step of passing air through said area to fluidize the acceptor in said area to promote the introduction of said acceptor into said bed.

3. The method of claim 1 further comprising the step of adding particulate fuel material to said area to add additional heat to said area.

4. The method of claim 3 further comprising the step of passing air through said area to promote the combustion of said fuel material in said area.

5. The method of claim 1 further comprising the step of introducing carbon dioxide-rich gas to said area to promote the calcining of said acceptor.

6. The method of claim 5 further comprising the steps of removing any excess carbon dioxide from said area.

7. The method of claim 1 wherein said acceptor is limestone.

8. A method of capturing sulfur in a fluidized bed boiler comprising the steps of passing air through a bed of particulate material containing fuel and supported in a housing to fluidize said particulate material, establishing a freeboard space in said housing above said bed of particulate material for receiving heat from said bed of particulate material, introducing into said freeboard space a raw acceptor for the sulfur produced as a result of combustion of said fuel, said freeboard space being in a heat transfer relation to the heat generated by said fluidized bed to calcine said acceptor, then permitting said calcined acceptor to discharge by gravity onto said bed where it reacts with said sulfur and discharging said sulfated acceptor from said bed.

9. The method of claim 8 further comprising the step of disposing at least one distribution unit in said freeboard space, said unit adapted to receive said raw acceptor and discharge same after the acceptor is calcined.

10. The method of claim 9 wherein two distribution units are disposed in said freeboard space, one of said units adapted to receive said raw acceptor and discharge the acceptor to the other unit, the other unit adapted to discharge the acceptor to the fluidized bed.

11. The method of claim 10 wherein said other distribution unit is disposed underneath said one unit and wherein said units are slanted so that said acceptor cascades down said units before discharging into said fluidized bed.

12. The method of claim 10 further comprising the steps of sizing said distribution units and regulating the flow rate of said acceptor through said units so that the residence time of said acceptor within said unit is sufficient to enable said acceptor to receive sufficient heat from said bed to calcine said acceptor.

13. The method of claim 12 further comprising the step of introducing carbon dioxide-rich gas to said distribution unit to promote the calcining of said acceptor.

14. The method of claim 13 further comprising the steps of removing any excess carbon dioxide from said distribution unit.

15. The method of claim 8 further comprising the step of positioning an enclosure above said bed in a manner to receive heat from said bed, said enclosure having an inlet for receiving said raw acceptor and an outlet for discharging said calcined acceptor towards said bed.

16. The method of claim 15 further comprising the steps of selecting the dimensions of said enclosure, said inlet and said outlets so that the residence time of said acceptor within said enclosure is sufficient to enable said acceptor to receive sufficient heat from said fluidized bed to calcine said acceptor.

17. The method of claim 15 further comprising the step of introducing carbon dioxide-rich gas to said enclosure unit to promote the calcining of said acceptor.

18. The method of claim 17 further comprising the steps of removing any excess carbon dioxide from said enclosure unit.

19. The method of claim 7 wherein said limestone is converted to lime as a result of said calcining.

* * * * *